US006056213A

United States Patent [19]

Ruta et al.

[11] Patent Number: 6,056,213

[45] Date of Patent: May 2, 2000

[54] MODULAR SYSTEM FOR ATOMIZING A LIQUID

[75] Inventors: Constantin I. Ruta, White Bear Lake; Russell E. Blette, Hastings; Roger W. Leinen, Woodbury, all of Minn.

[73] Assignee: 3M Innovative Properties Company, St. Paul, Minn.

[21] Appl. No.: 09/019,463

[22] Filed: Jan. 30, 1998

[51] Int. Cl.[7] ..... B05B 7/32; B65D 1/32

[52] U.S. Cl. ..... 239/337; 239/323; 239/327; 239/353; 239/364; 239/369

[58] Field of Search ..... 239/290, 323, 239/327, 337, 353, 340, 364, 369, 371, 423

[56] References Cited

U.S. PATENT DOCUMENTS

| | | | |
|---|---|---|---|
| 1,191,751 | 7/1916 | Walkup | 239/353 X |
| 1,608,833 | 11/1926 | Birkenmaier et al. . | |
| 1,706,006 | 3/1929 | Thompson | 239/340 X |
| 1,736,356 | 11/1929 | Mueller . | |
| 1,777,925 | 10/1930 | Kollmann | 239/353 X |
| 1,811,637 | 6/1931 | Ladisch . | |
| 1,956,506 | 4/1934 | Johnson | 158/74 |
| 2,502,210 | 3/1950 | Demuth | 158/76 |
| 3,310,240 | 3/1967 | Grundman | 239/404 |
| 3,468,487 | 9/1969 | Warren | 239/403 |
| 3,515,354 | 6/1970 | Presson | 239/416.5 |
| 3,770,207 | 11/1973 | Müller et al. | 239/397.5 |
| 3,848,807 | 11/1974 | Partida | 239/290 |
| 3,864,073 | 2/1975 | Kolhi | 431/115 |
| 3,876,150 | 4/1975 | Dwyer, Jr. et al. | 239/424 |
| 3,880,356 | 4/1975 | Chandler | 239/308 |
| 3,905,554 | 9/1975 | Bell | 239/424 |
| 3,986,668 | 10/1976 | Huhne et al. | 239/85 |
| 4,043,510 | 8/1977 | Morris | 239/323 |
| 4,171,096 | 10/1979 | Welsh et al. | 239/291 |
| 4,174,068 | 11/1979 | Rudolph | 239/322 |
| 4,221,339 | 9/1980 | Yoshikawa | 239/704 |
| 4,263,346 | 4/1981 | Sandell | 427/196 |
| 4,555,059 | 11/1985 | Collins et al. | 239/425 |
| 4,610,760 | 9/1986 | Kirkpatrick et al. | 159/4.01 |

(List continued on next page.)

FOREIGN PATENT DOCUMENTS

| | | |
|---|---|---|
| 0 293 065 | 3/1988 | European Pat. Off. . |
| 0 819 473 A1 | 1/1998 | European Pat. Off. . |
| 914 768 | 10/1946 | France . |
| 671 346 | 8/1989 | Switzerland . |
| WO 93/20971 | 10/1993 | WIPO . |
| 94/20204 | 9/1994 | WIPO . |
| 97/11784 | 4/1997 | WIPO . |

OTHER PUBLICATIONS

Air Stream Blocks Jet–Engine Noise, News & Notes.

Optimization of a Plain–Jet Airblast Atomizer, Atomization and Sprays, vol. 7, pp. 97–113, 1997.

Atomization, A Fundamental Aerosol Attribute, Research & Development, Spray Technology & Marketing for May 1997, by Montfort A. Johnsen, pp. 34–39.

Aerosols Products, The Aerosol Market, pp. 226–236.

Atomization and Sprays, by Arthur H. Lefebvre, Purdue University, West Lafayette, Indiana, Copyright © 1989 by Hemisphere Publishing Corporation.

*Primary Examiner*—Andres Kashnikow
*Assistant Examiner*—Robin O. Evans

[57] ABSTRACT

A modular system for atomizing and delivering liquids to a substrate. The modular system comprises a liquid module, a means for providing an atomizing agent, a nozzle assembly and an actuator which is changeable between a first closed position and a second open position, for selectively allowing the atomizing agent to flow from the means for providing atomizing agent to the atomizing agent channel and for selectively allowing the liquid to flow from the cavity to the liquid delivery nozzle. The modular system atomizes liquids into a narrow distribution of particle sizes without the use of propellants or solvents. The modular system has replaceable liquid and atomizing agent modules. A method for atomizing liquids is also disclosed.

48 Claims, 10 Drawing Sheets

U.S. PATENT DOCUMENTS

| | | | |
|---|---|---|---|
| 4,679,059 | 7/1987 | Dagna | 346/140 |
| 4,682,565 | 7/1987 | Carrico | 118/719 |
| 4,715,518 | 12/1987 | Moore | 222/257 |
| 4,760,956 | 8/1988 | Mansfield | 239/8 |
| 4,801,412 | 1/1989 | Miller | 264/12 |
| 4,880,162 | 11/1989 | Howells et al. | 239/406 |
| 4,891,249 | 1/1990 | McIntyre | 427/421 |
| 4,960,244 | 10/1990 | Maag et al. | 239/424 |
| 4,964,540 | 10/1990 | Katz | 222/95 |
| 5,090,623 | 2/1992 | Burns et al. | 239/301 |
| 5,160,086 | 11/1992 | Kuykendal et al. | 239/18 |
| 5,181,661 | 1/1993 | Wollard | 239/704 |
| 5,193,748 | 3/1993 | Wittersheim et al. | 239/337 |
| 5,256,352 | 10/1993 | Snyder et al. | 261/78.2 |
| 5,292,068 | 3/1994 | Raterman et al. | 239/11 |
| 5,322,564 | 6/1994 | Ludwig et al. | 118/300 |
| 5,335,862 | 8/1994 | Esper | 239/570 |
| 5,356,050 | 10/1994 | Hahn et al. | 222/394 |
| 5,375,766 | 12/1994 | Sweeney | 239/133 |
| 5,409,162 | 4/1995 | Sickles | 239/3 |
| 5,418,009 | 5/1995 | Raterman et al. | 427/207.1 |
| 5,427,317 | 6/1995 | Hüttlin | 239/422 |
| 5,431,342 | 7/1995 | Saripalli et al. | 239/102.2 |
| 5,431,343 | 7/1995 | Kubiak et al. | 239/105 |
| 5,478,014 | 12/1995 | Hynds | 239/135 |
| 5,526,981 | 6/1996 | Sanson | 239/8 |
| 5,533,675 | 7/1996 | Benecke et al. | 239/413 |
| 5,536,531 | 7/1996 | Owen et al. | 427/256 |
| 5,540,385 | 7/1996 | Garlick | 239/290 |
| 5,549,246 | 8/1996 | Kukesh | 239/9 |
| 5,558,277 | 9/1996 | Owen et al. | 239/322 |
| 5,579,998 | 12/1996 | Hall et al. | 239/9 |
| 5,590,520 | 1/1997 | Papamoschou | 60/204 |
| 5,618,347 | 4/1997 | Clare et al. | 118/314 |
| 5,620,139 | 4/1997 | Ziecker | 239/124 |

MODULAR SYSTEM FOR ATOMIZING A LIQUID

TECHNICAL FIELD

The present invention relates generally to a modular system and method for atomizing liquids. More specifically, the invention relates to a modular system and method which may be used with liquids difficult to atomize.

BACKGROUND OF THE INVENTION

In many aerosol spray applications, it is desirable to deliver a spray of small particles (1–200 microns in diameter) having generally uniform diameters. Uniformly small particles, also referred to as droplets, when applied to a surface, can coalesce into thin surface coatings having uniform thickness. Such consistently and predictably thin coatings dry more rapidly and evenly than coatings formed from aerosol systems that deliver droplets of variable sizes. It is also believed that such variably thick spray coatings, due to their associated uneven drying times, may not bond to surfaces as strongly as coatings formed from uniformly thin droplets. This is particularly undesirable in applications where permanent and uniform coating/surface bonding is essential, such as with spray paints and adhesives. Hence, there are several techniques which have been used to reduce particle size.

In conventional aerosol spray systems, propellants have been applied to reduce aerosol particle size. In addition to providing the pressure required to force the aerosol out of the container when the actuator is depressed, the propellant plays an essential role in fluid particle formation and the overall spray characteristics of the aerosol. When the propellant/fluid mixture is discharged from such aerosol dispensing systems, fluid particles are initially formed as a result of the vaporization of the propellant and the kinetic energy imparted by the propellant to the liquid. Particle size continues to reduce as the particle travels farther from the dispenser orifice as a result of further propellant vaporization and release of kinetic energy.

Thus, choice of propellant is a critical consideration in aerosol droplet formation. In general, the vapor pressure and concentration of the propellant are the variables that most directly affect aerosol droplet size. As the concentration or vapor pressure of the propellant increases, droplet size typically decreases.

Droplet size also depends on the viscosity of the fluid. Many high viscosity polymers, such as those used in adhesives and paints, are incapable of being sprayed as small droplets using conventional aerosol dispensing systems, even if propellants having high vapor pressures and/or concentrations are used. To make such high viscosity materials sprayable, a solvent that is compatible with both the fluid and propellant of the aerosol mixture must be added. To obtain sprayable mixtures of such high viscosity materials, solvent solutions having 20% or less by weight solids content are often required.

The actuator or nozzle design also influences aerosol droplet size. Orifice size and taper can be manipulated to tailor droplet size, as well as alter the aerosol spray pattern. Designs that atomize the fluid stream by diverting the propellant within the actuator (so called "mechanical break-up actuators") have also been developed. Such designs form smaller droplets by first inducing a swirling motion of the fluid within the actuator. When the swirling liquid exits the actuator orifice, atomization of the aerosol is enhanced over conventional systems due to the tangential motion of the swirling aerosol formulation.

All of these approaches in reducing aerosol droplet size, however, have associated drawbacks in producing uniformly small droplets. In conventional contained aerosol spray systems, the actual propellant concentration of the aerosol as it leaves the dispensing system is in continuous flux, even though an average overall propellant/fluid ratio exists. This variability is a result of several factors. In particular, the unavoidable uneven mixing of aerosol components in such contained systems results in lack of constant propellant concentration, resulting in a variability of aerosol droplet sizes.

Fluctuation in vapor pressure is also inevitably present in such systems. The turbulent fluid flow that is used to propel the aerosol from the dispensing system is variable by definition, relying on a continuously changing oscillatory force to drive the aerosol from the canister. It is also well known that the pressure in such systems decreases as the container empties. Both of these factors further contribute to variability of droplet sizes using these dispensing systems.

Although effective in transforming polymeric materials into sprayable mixtures, in many situations and locations the use of solvents is undesirable and/or not permitted. In the coatings industries, particularly in the development of adhesive products, efforts have been undertaken to remove solvents from formulations.

Water-based sprayable polymeric materials have been developed as alternatives to solvent borne aerosol formulations, but must often be formulated at lower solids levels and viscosities to be effectively atomized using conventional aerosol systems. Several drawbacks are associated with these reductions in solids content and viscosity. Lower solids content results in less deliverable material in a given canister or reservoir volume, translating into greater inconvenience and expense in using such materials. Lower viscosity polymers, by definition, typically also possess inferior physical and mechanical properties when compared to solvent-based, higher viscosity polymers. Thus, solvent elimination can also lead to performance compromises and concessions in sprayable polymeric formulations.

Furthermore, conversion to water-based formulations has resulted in a greater tendency for solidified polymeric and other materials to accumulate within the conventional aerosol system actuator and orifice. Solids accumulation and clogging had not been a significant problem in solvent-based aerosol systems because solids buildup was prevented and/or quickly dissolved by the solvent's presence in the system. Such solids buildup within the actuator associated with the use of water-based formulations, however, diminish the effectiveness of mechanical break-up systems in atomizing aerosols by clogging or altering the internal actuator channels that provide enhanced droplet formation.

What is desired is a system for atomizing liquids into a narrow distribution of particle size without the use of propellants or solvents. Additionally, it is desirable to have a system which atomizes high viscosity liquids or liquids with greater than 17% solids. It is also desirable to have a modular system with replaceable liquid and atomizing agent modules.

SUMMARY OF THE INVENTION

One aspect of the present invention provides a modular system for atomizing and delivering a liquid. The modular system comprises a liquid module, a means for providing an atomizing agent, a nozzle assembly and an actuator which is changeable between a first closed position and a second open position, for selectively allowing the atomizing agent to flow from the means for providing atomizing agent to the atomizing agent channel and for selectively allowing the liquid to flow from the cavity to the liquid delivery nozzle. The liquid module includes a liquid, a reservoir body including a cavity for storing the liquid, and a reservoir opening for allowing the liquid to exit the cavity. The reservoir body is under force so as to pressurize the liquid. The nozzle assembly includes a liquid delivery nozzle in fluid communication with the reservoir opening. The liquid delivery nozzle includes a liquid nozzle exit at a first end of the nozzle and an atomizing agent channel in fluid communication with the means for providing an atomizing agent. The atomizing agent channel is configured such that the atomizing agent impinges the liquid external of the liquid nozzle exit so as to atomize the liquid.

In the above system, the means for providing an atomizing agent may be an atomizing agent module. The system may further comprise a housing, in which the nozzle assembly, the actuator, the liquid module, and the atomizing agent module are attached to the housing. The liquid delivery nozzle may be releasably attached to the nozzle assembly, and the liquid delivery nozzle is attached to the liquid module. This way, the liquid delivery nozzle and the liquid module comprise a unit which is releasably attached to the housing. The atomizing agent module may be releasably attached to the housing. The housing may be sized and configured to be hand held by a user. The atomizing agent may comprise a compressed gas. The atomizing agent may comprise a liquefied gas.

In the above system, the liquid module further may comprise a canister, with the reservoir body housed in the canister.

In the above system, the liquid module and the liquid delivery nozzle may be attached to one another and removable from the system as a unit. The reservoir body can include a bladder for storing the liquid wherein the bladder includes an inside surface defining the cavity and an outside surface. The liquid module may further include pressurized gas in the canister outside the reservoir body so as to pressurize the liquid.

In the above system, the reservoir body may comprise a bladder for storing the liquid, wherein the bladder includes an inside surface defining the cavity and an outside surface, and wherein the liquid module further includes an elastic member contacting the outside surface so as to pressurize the liquid. The elastic member may be a sleeve disposed on the bladder.

The above system may include a regulator to maintain the atomizing agent at a constant pressure at the atomizing channel.

In the above system, the liquid module further may comprise a valve for selectively allowing the liquid to exit the cavity through the reservoir opening. The liquid delivery nozzle may include a second end opposite the exit, wherein the second end is operatively connected to the liquid module valve, and wherein the actuator displaces the liquid module relative to the liquid delivery nozzle so as to cause the nozzle to open the valve.

In a preferred embodiment of the above system, changing the actuator from closed to open initially allows the atomizing agent to flow from the means for providing an atomizing agent to the atomizing agent channel and subsequently allows the liquid to flow from the liquid module to the liquid delivery nozzle, while the atomizing agent is still flowing.

In the above system, the atomizing agent channel may be at an angle relative to the longitudinal axis of the liquid delivery nozzle of between 25–50°. The atomizing agent channel may be concentric with the liquid delivery nozzle. The atomizing agent channel may preferably be at an angle relative to the liquid delivery nozzle of approximately 33–46°. The atomizing agent channel may be more at angle preferably relative to the liquid delivery nozzle of 33°.

In the above system, the atomizing agent channel may be concentric with the liquid delivery nozzle.

In the above system, the liquid delivery nozzle may include a smooth, continuous pathway from the reservoir opening to the liquid delivery nozzle exit having a surface finish of SPI #A1 whereby the fluid flows in a laminar manner from the liquid module into the liquid delivery nozzle, and exits the nozzle assembly.

In one preferred embodiment of the above system, the liquid may have a viscosity of no more than 5000 centipoise.

In the above system, the liquid may comprise a polymer. In the above system, the liquid may comprise an adhesive. The adhesive may comprise a water-based adhesive. The adhesive may comprise a water-based pressure sensitive adhesive. The water-based adhesive may have greater than 17% solids by weight. The water-based adhesive may preferably have between 17% to 70% solids by weight.

Another aspect of the present invention provides a system for atomizing and delivering a liquid, comprising a liquid module, a means for providing an atomizing agent, a nozzle assembly, and an actuator for selectively allowing the atomizing agent to flow from the means for providing atomizing agent to the atomizing agent channel and for selectively allowing the liquid to flow from the cavity to the liquid delivery nozzle. The liquid module comprises a liquid and a reservoir body including a cavity for storing the liquid, including a reservoir opening for allowing the liquid to exit the cavity, wherein the reservoir body is under force so as to pressurize the liquid. The nozzle assembly comprises a liquid delivery nozzle in fluid communication with the reservoir opening, the liquid delivery nozzle including a liquid nozzle exit at a first end of the nozzle and an atomizing agent channel in fluid communication with the means for providing an atomizing agent, wherein the atomizing agent channel is configured such that the atomizing agent impinges the liquid external of the liquid nozzle exit so as to atomize the liquid. The liquid delivery nozzle is releasably attached to the nozzle assembly, and the liquid delivery nozzle is attached to the liquid module. The liquid delivery nozzle and the liquid module comprise a unit which is releasable from the system. Many of the features of the previous system above are applicable here.

A further aspect of the present invention provides a method of atomizing a liquid comprising the steps of: a) flowing a liquid in a laminar state along a spray axis through a nozzle, b) dispensing the liquid to exit the nozzle in a laminar flow, c) impinging an annular flow of atomizing agent between 0.020 and 0.080 inches downstream of the exit of the nozzle onto the liquid at an angle of 25–50° relative to the spray axis and d) atomizing the entire flow of liquid into a distribution having a mean particle size from 5 to 500 microns in diameter.

In one preferred embodiment, step a) further comprises flowing the liquid at a constant flow rate.

In the above method, the liquid may preferably have a viscosity of no more than 5000 centipoise. The liquid may comprise a polymer. The liquid may comprise an adhesive. The adhesive may comprise a water-based adhesive. The water-based adhesive may have greater than 17% solids by weight.

In the above method, the flow of liquid may remain laminar up to the point of impingement. In the above method, the angle of impingement may be 33–46°. In the above method, the atomizing agent may be a compressed gas. In the above method, the atomizing agent may be a liquefied gas.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

Figure 1:
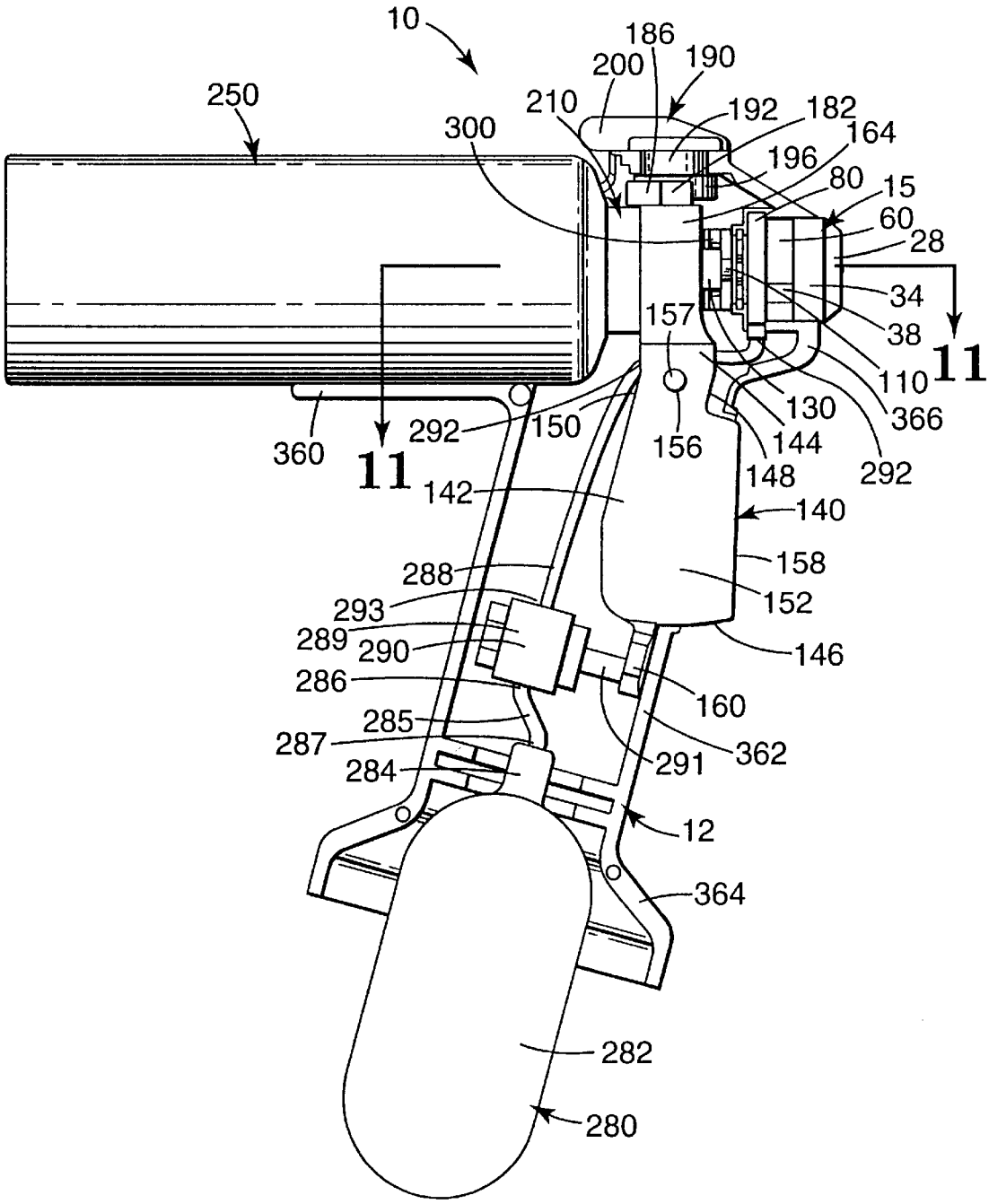
FIG. 1 is a side view of a preferred embodiment of the modular system of the present invention, with the right side of the housing removed.

The present invention is a modular system 10 for atomizing liquids. As seen in FIG. 1, the modular system includes a liquid module 250, a means for providing an atomizing agent, preferably an atomizing agent module 280, nozzle assembly 15, and an actuator preferably comprising trigger linkage 140 and valve assembly 289. The modular system atomizes liquids which are typically difficult to atomize by impinging an annular stream of an atomizing agent onto a laminar stream of liquid. Atomization takes place outside nozzle assembly 15, and the entire flow of liquid is atomized into small, generally uniform, fine particle sizes.

Figure 2:
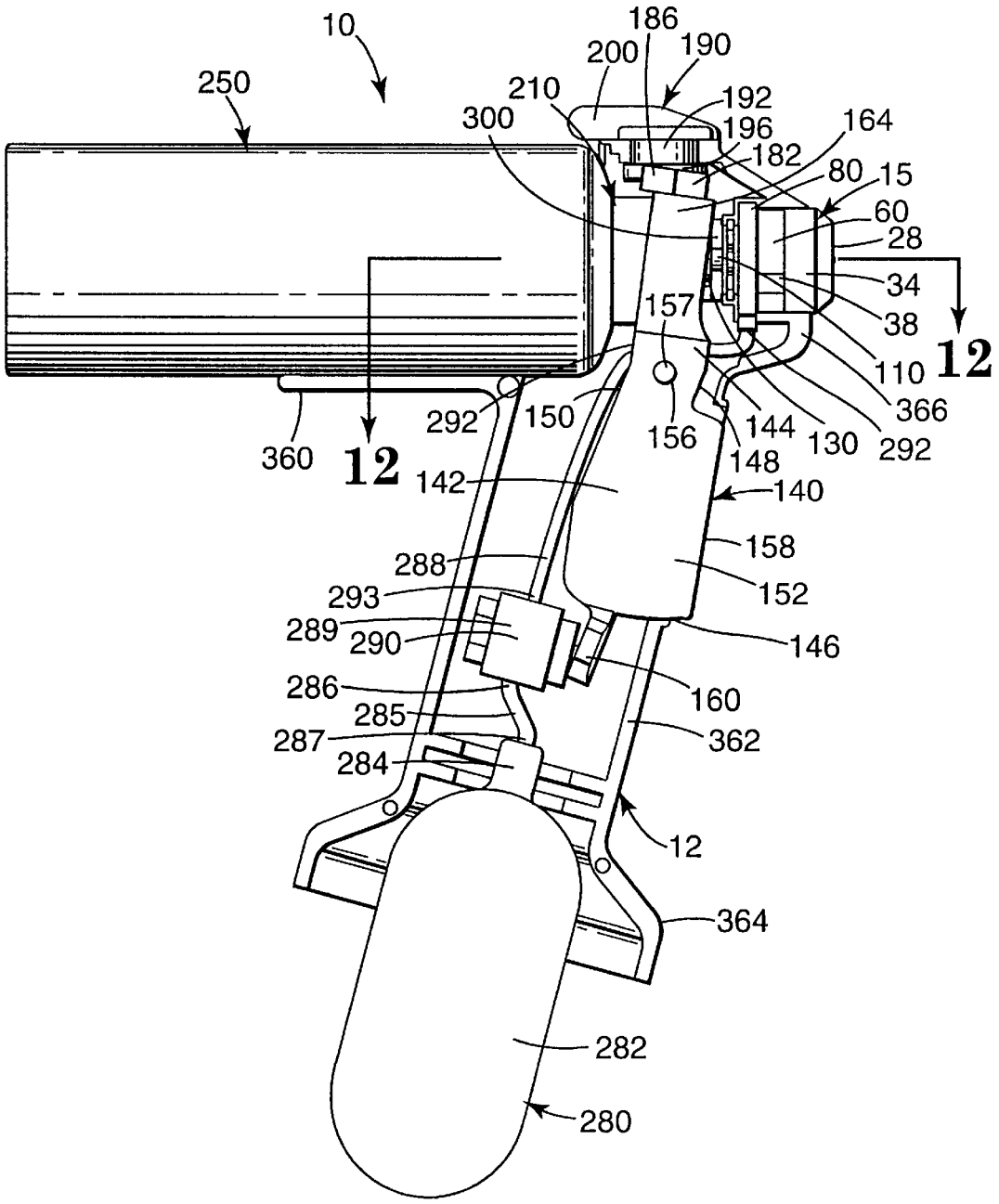
FIG. 2 is a view of the modular system of FIG. 1, showing the trigger depressed.

FIGS. 1 and 2 illustrate one preferred embodiment of modular system 10 of the present invention. FIG. I is a side plan view of modular system 10 of the present invention with the right side half of the housing 12 removed. The housing 12 is configured to allow the liquid module 250 and atomizing agent module 280 to be conveniently removed and replaced. Housing 12 includes a liquid module portion 360, for releasably receiving liquid module 250, atomizing agent module portion 364, for releasably receiving atomizing agent module 280, a handle portion 362, for housing valve assembly 289 and trigger linkage 140, and nozzle portion 366, for housing nozzle assembly 15.

In the illustrated embodiment, atomizing agent module 280 is a self-contained canister 282 containing an atomizing agent. Suitable canisters include those commercially available from Crown Cork and Seal Co., Philadelphia, Pa., and United States Can, Inc., Oak Brook, Ill. Preferably the atomizing agent is a compressed gas, such as air or carbon dioxide, or a liquefied gas. Examples of suitable liquefied gases include: propane, isobutane, dimethyl ether, difluoroethane, and tetrafluoroethane, or blends thereof which are commonly available in the aerosol industry. Located on top of canister 282 is a connector 284, which engages with first conduit 285 as is well known in the art. First conduit 285 has a first end 286 and a second end 287 opposite the first end 286. Second end 287 is connected to connector 284 on the canister 282. First end 286 is connected to valve assembly 289.

Valve assembly 289 controls the flow of atomizing agent from first conduit 285 to second conduit 288. Second conduit 288 has a first end 292 and a second end 293 opposite first end 292. First end 292 of second conduit 288 is connected to nozzle assembly 15. Second end 293 of second conduit 288 is connected to valve assembly 289. Valve assembly 289 includes valve 290 and valve stem 291. Valve assembly 289 is changeable between a first closed position and a second open position. Valve 290 contains a regulator for regulating the flow and pressure of the atomizing agent from first conduit 285 to second conduit 288. For most liquids usable with this invention and for desired particle sizes, the optimum pressure to be maintained after the regulator is 32–38 PSI (1.5 to 1.8 kPa).

In the illustrated embodiment, trigger linkage 140 includes an elongated pivot body 142, trigger 158, extension 160, and arms 164, 166. Pivot hole 156 of the trigger linkage is in rotatable engagement about pivot 157 which extends from the side of the housing 12. FIG. 1 shows trigger linkage 140 at rest. FIG. 2 illustrates trigger linkage 140 being depressed.

As seen in FIG. 2, when trigger 158 is depressed, trigger linkage 140 rotates about pivot 157. This rotation causes extension 160 to depress valve stem 291. When valve stem 291 is depressed, valve 290 changes from the first closed position to the second open position. When valve 290 is in the open position, atomizing agent flows from canister 282, through first conduit 285, through valve 290, and continues to flow through second conduit 288, into nozzle assembly 15. In addition, rotation of trigger linkage 140 moves liquid module 250 toward nozzle assembly 15, as will be explained in greater detail below.

Figure 3:
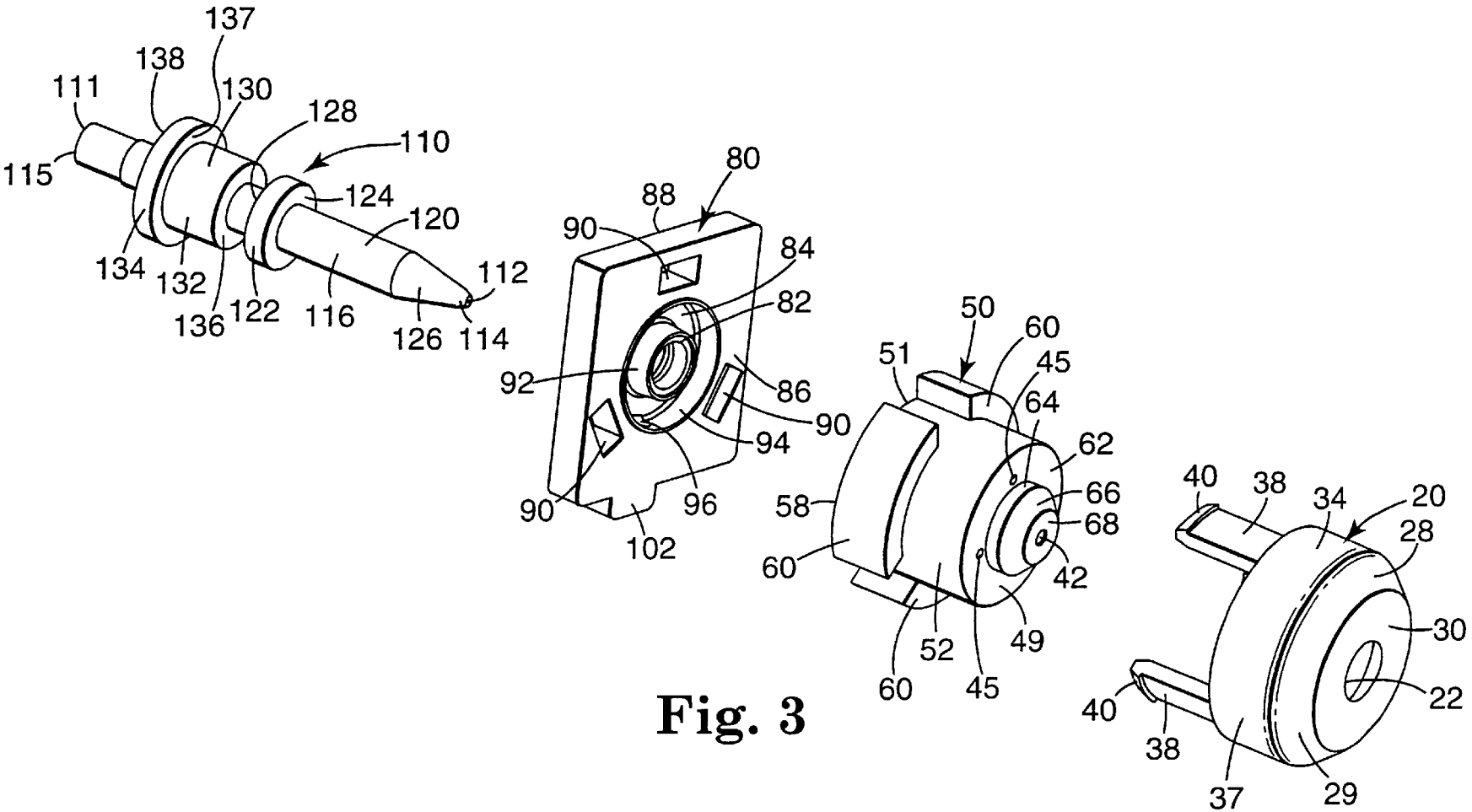
FIG. 3 is an exploded isometric view of the nozzle assembly.

FIG. 3 illustrates one preferred embodiment of nozzle assembly 15. Nozzle assembly 15 includes four parts: liquid delivery nozzle 110, plate 80, channel body 50, and channel cap 20. Liquid delivery nozzle 110 has cylindrical body 116 having an outer surface 120, a first end 114 and a second end 115 opposite first end 114. Liquid delivery nozzle 110 includes an inner liquid channel 118, as discussed in more detail with regard to FIG. 9. At first end 114 is a taper 126 that ends at liquid nozzle exit 112. Liquid nozzle entrance 111 is located at second end 115. Forward flange 122 is located around the periphery of body 116, between first and second ends 114, 115 of liquid delivery nozzle 110. Forward flange 122 includes front face 124 and rear face 128 opposite front face 124. Rear flange 130 is located between forward flange 122 and second end 115. Rear flange 130 includes front portion 132 and rear portion 134. Front portion 132 has a front face 136. Rear portion 134 of the rear flange 130 has a larger diameter than forward flange 122 and front portion 132 of rear portion 134. Rear portion 134 has a front face 137 and a rear face 138 opposite front face 137.

Plate 80 has a front face 86 and a rear face 88 opposite front face 86. Plate 80 includes hole 82 therethrough, and an annular channel 84 around hole 82 that is open to the front face 86 of plate 80. Hole 82 is located in the general center of plate 80. Annular channel 84 has an inner wall 92 and an outer wall 94. Plate 80 also includes stand up 102 extending from the base of plate 80. Feed channel 96 extends through the middle of stand up 102 and is in fluid communication with annular channel 84. Feed channel 96 serves as a passageway for the atomizing agent to flow from standup 102 into annular channel 84. Snap fit holes 90 are located equidistant around annular channel 84. Preferably the number of snap fit holes 90 are equal to the number of legs 40 of channel body 50. In the illustrated embodiment, plate 80 has three snap fit holes 90.

Channel body 50 includes a cylindrical body 52 having a first end 49 and second end 51 opposite first end 49. Extending from first end 49 is a shoulder 64 and a tapered surface 66 ending at front face 68. Located in the general center of front face 68 is liquid nozzle orifice 42. Atomizing agent orifices 45 are located on first end 49 equidistant about shoulder 64. In the illustrated embodiment, body 50 has three atomizing agent orifices 45. Channel body 50 also includes rear flanges 60 which are located equidistant around cylindrical body 52, near second end 51. In the illustrated embodiment, channel body 50 has three flanges 60. Rear flanges 60 each have a rear face 58. The spacing between the flanges 60 are sized and positioned to receive legs 38 of channel cap 20, described more fully below.

Channel cap 20 includes a cylindrical body 34 having an inner surface 36 and an outer surface 37. Extending from the front of body 34 is a wall 28. Wall 28 has a taper 29 leading down to a face 30 and forming orifice 22. Orifice 22 is located in the general center of face 30. Extending rearward from cylindrical body 34 and spaced equidistant are a plurality of legs 38, each having a foot 40. In the illustrated embodiment, channel cap 20 has three legs.

Nozzle assembly 15 may be assembled by first positioning channel body 50 and plate 80 together so that snap fit holes 90 of plate 80 are between adjacent flanges 60 of channel body 50. Next, channel cap 20 is placed over channel body 50 and plate 80 by positioning the legs 38 of channel cap 20 between adjacent flanges 60 to allow feet 40 of channel cap 20 to engage with snap fit holes 90 of plate 80. After channel cap 20, channel body 50, and plate 80 are assembled as a unit, then liquid delivery nozzle 110 may be slid in and out of engagement with this unit through hole 82 of plate 80.

Figure 4:
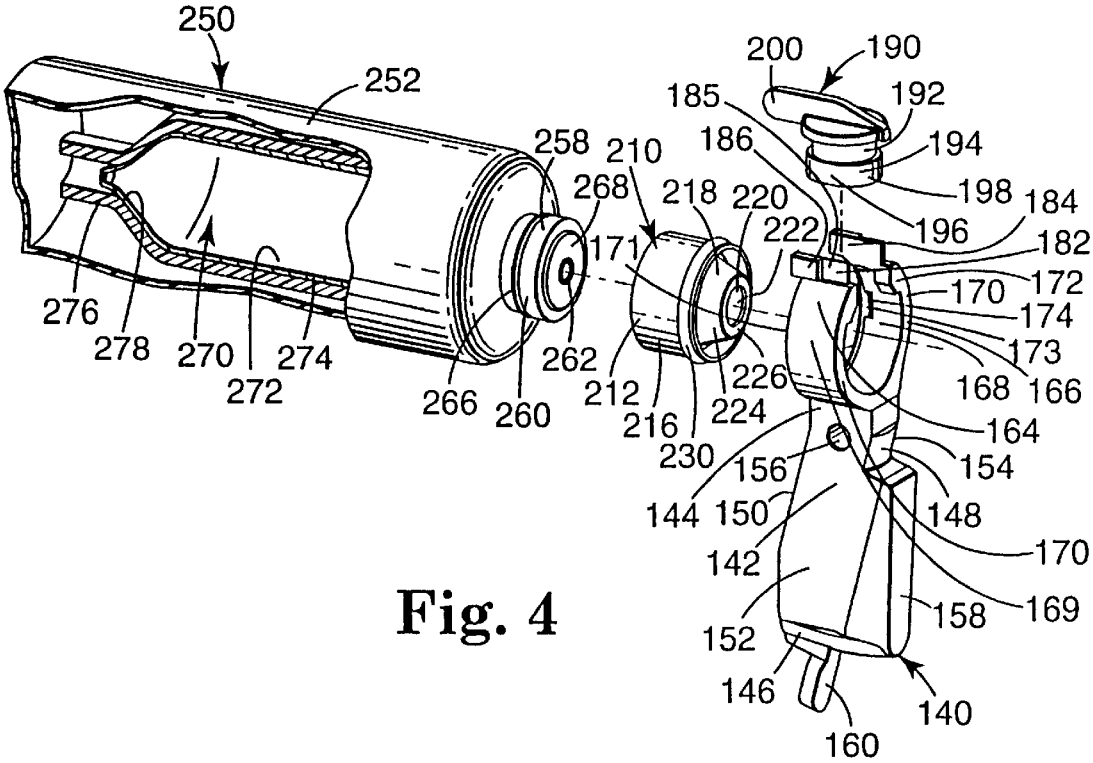
FIG. 4 is a front isometric view of the liquid module, collar, trigger linkage and spreader cam, showing the liquid module in a partial cross-sectional view.

FIG. 4 illustrates one preferred embodiment of spreader cam 190, liquid module 250, collar 210, and trigger linkage 140.

In one preferred embodiment of liquid module 250, liquid module 250 includes a canister 252, cap 258, and reservoir body located within canister 252. In the illustrated embodiment, reservoir body is a bladder 270. Bladder 270 has an inside surface 272 and outside surface 274. Liquids to be atomized are stored inside bladder 270. Elastic sleeve 276 has a inside surface 278, which completely surrounds the outside surface 274 of bladder 270. Elastic sleeve 276 is preferably made of natural rubber. Elastic sleeve 276 applies a relatively constant pressure to the liquids stored in bladder 270 to allow liquids to exit the module 250 in laminar flow. After most of the liquid has been expelled from bladder 270, the pressure applied by the sleeve 276 will begin to decrease. Liquid module cap 258 has a cylindrical outside surface 260 and a front face 268. Orifice 262 is located in the middle of face 268 and a rear collar 266 is located around the periphery of outside surface 260.

Suitable commercially available embodiments of liquid module 250 include the Atmos™ System available from Exxel/Atmos, Inc. located in Somerset, N.J.; and modules available from EP Systems, Inc. located in East Hanover, N.J.

Figure 5:
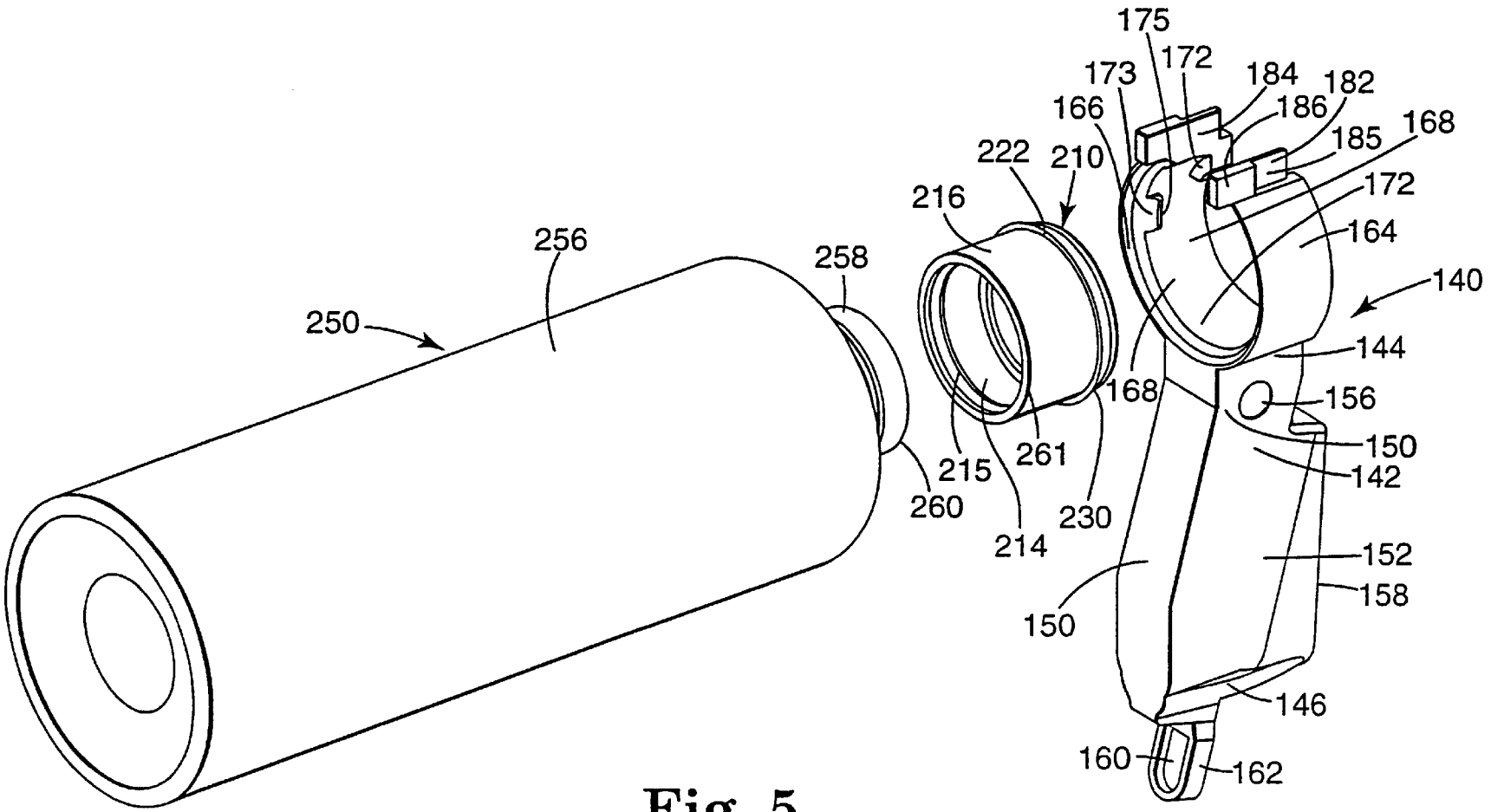
FIG. 5 is a rear isometric view of the liquid module, collar and trigger linkage shown in FIG. 4.

Collar 210 is shown in both FIG. 4 and FIG. 5. The function of collar 210 is to engage with both liquid module 250 and trigger linkage 140 thereby releasably attaching the liquid module 250 to trigger linkage 140. Collar 210 also holds the liquid delivery nozzle 110 on liquid module 250. Collar 210 includes a generally cylindrical body 212 with an inside surface 214 and outside surface 216. Around the periphery of inside surface 214 is inside lip 215 that engages with rear collar 266 on the liquid module 250. Collar 210 includes cone 218 extending from body 212. Cone 218 has an outside surface 224 and a front face 226 surrounding orifice 220. Lip 230 is located around the outer surface of cylindrical body 212 adjacent the cone 218 for engagement with the trigger linkage 140.

Trigger linkage 140 is shown in both FIG. 4 and FIG. 5. In the illustrated embodiment, trigger linkage 140 includes a elongated pivot body 142, trigger 158, extension 160, and arms 164, 166. Trigger body 142 has a first end 144 and second end 146 opposite first end 144. Body 142 has a front surface 148 and a rear surface 150 opposite front surface 148. Body 142 has a first side 152 and second side 154 opposite first side 152. Extension 160 extends from second end 146. Trigger 158 is located at front surface 148. A pivot hole 156 is located near the first end 144 for attaching trigger linkage 140 to the pivot mount 157 of housing 12. First arm 164 and second arm 166 extend from first end 144 of pivot body 142. Each arm 164, 166 has an inside surface 168 and an outside surface 169 opposite inside surface 168. Each arm 164, 166 has a front surface 170 and a back surface 171 opposite front surface 170. Stoppers 172 are located around the circumference of inside surface 168, near front surface 170. Stoppers prevent collar 210 from sliding forward of the arms 164, 166 during assembly. Ramps 173 are located around the circumference of inside surface 168, near back surface 171. Each ramp 173 includes edge 174 and forward face 175. In the illustrated embodiment, each arm 164, 166 has one stopper 172 and one ramp 173. Extending from arms 164, 166 are individual cam followers 182. Each cam follower 182 has an inside surface 184 and an outside surface 185 opposite inside surface 184. Located on the outside surface 184 of each cam follower 182 is a abutment 186. Arms 164, 166 of trigger linkage 140 are designed to engage with the collar 210 which has already been attached to liquid module 250.

Spreader cam 190 is used to spread inner surfaces 184 of first arm 164 and second arm 166 apart for receiving collar 210 of liquid module 250. Spreader cam 190 has a cylindrical body 192. Cam surface 194 is located on the bottom of body 192 and handle 200 is located on top of body 192 opposite cam surface 194. Cam surface 194 has opposing flats 196 and rounded portions 198.

Figure 6:
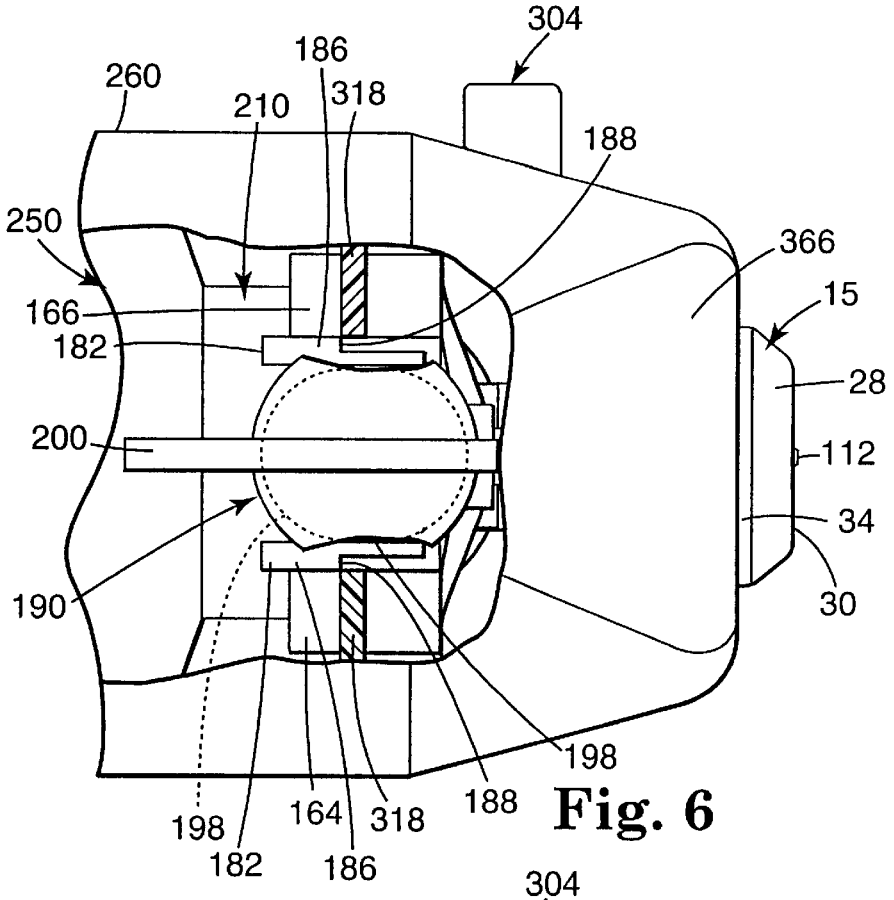
FIG. 6 is a partial top view of the modular system of FIG. 1, with the housing partially broken away and with the spreader cam partially broken away.
Figure 6A:
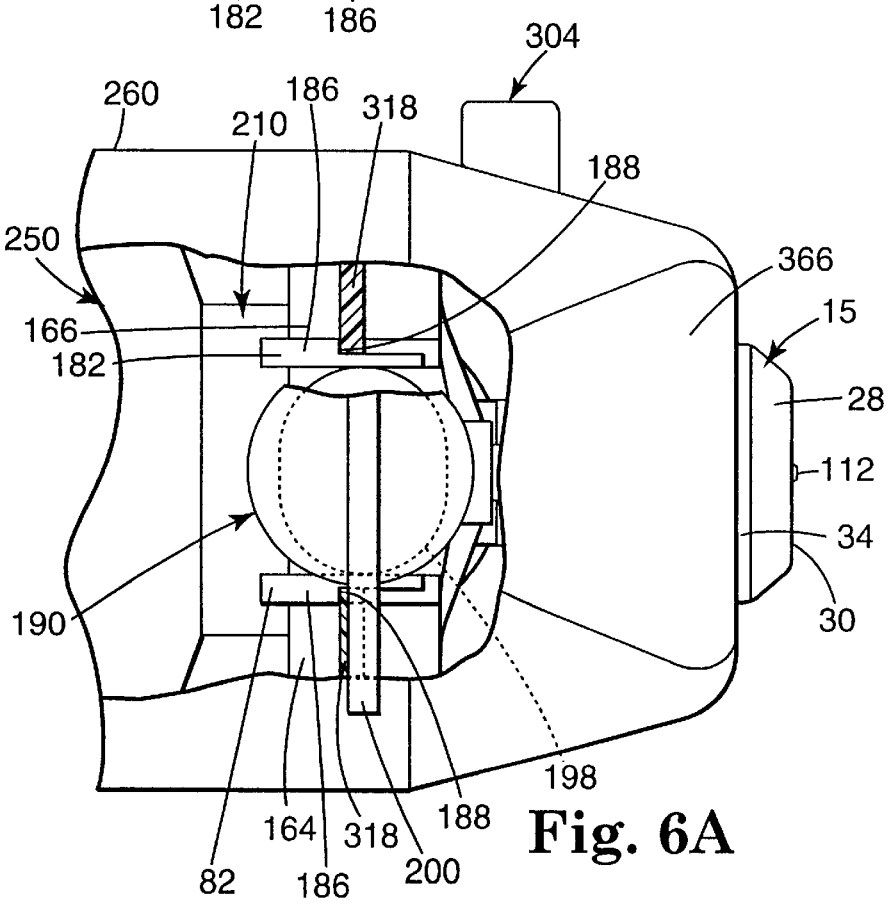
FIG. 6A is a view like FIG. 6, showing cam spreader rotated 90°.

FIG. 6 and FIG. 6A are partial top views of modular system 10 with part of housing 12 broken away and with part of spreader cam 190 broken away. Spreader cam 190 spreads apart arms 164, 166 to receive collar 210 which has already been snap fit to cap 258 of liquid module 250. FIG. 6 shows cam spreader 190 in a first position in which collar 210 and liquid module 250 are locked in position. FIG. 6A shows cam spreader 190 in a second position in which collar 210 and liquid module 250 are not locked in position.

As illustrated in FIG. 6 and FIG. 6A, spreader cam 190 engages with cam followers 182 of first arm 164 and second arm 166. In the first position, flats 196 of spreader cam 190 are in contact with inside surfaces 184 of cam followers 182. In the first position, arms 164, 166 lock collar 210 into place between stoppers 172 and ramps 173. After all the liquid has been dispelled from the liquid module 250, spreader cam 190 can be rotated 90° into the second position by turning its handle 200, as shown in FIG. 6A. This rotation causes rounded portions to come into contact with inside surfaces 184 of cam followers 182 and spreads apart arms 164, 166. When arms 164, 166 are spread apart, collar 210 and liquid module 250 are no longer locked in place by stoppers 172 and ramps 173. Then liquid module 250, collar 210 and liquid delivery nozzle 110 as a unit may be pulled out of the liquid module portion 360 of housing 12. Once collar 210 and liquid module 250 are pulled out of modular system 10, they may then be replaced with a replacement collar 210 and liquid module 250 containing a full bladder 270 of liquid, and liquid delivery nozzle 110. Additionally, when spreader cam 140 is in the second position, abutment 186 engages with retaining wall 318 located inside the nozzle portion 366 of housing 12. When locking surface 188 of abutment 186 engages with retaining wall 318, trigger linkage 140 may not pivot forward toward the nozzle. When a user is putting in a new liquid module 250, with liquid delivery nozzle 110 mounted on the cap 258 of liquid module 250, into modular system 10, this locking configuration ensures that the user does accidentally release liquid by depressing the liquid delivery nozzle 110 into liquid module 250 and that atomizing agent is not accidentally released by depressing valve system 291 with extension 160 of trigger linkage 140.

Figure 7:
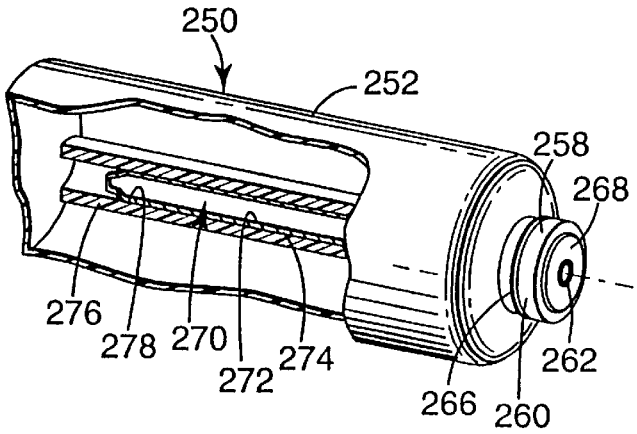
FIG. 7 is a partial cross-sectional view of the liquid module, showing the bladder deflated.

FIG. 7 is a view of the liquid module of FIG. 4, showing bladder 270 deflated after the liquid has be expanded. Bladder 270 has been compressed by elastic sleeve 276. After all the liquid has been expanded, liquid module 250 can be replaced with a new liquid module 250.

Figure 8:
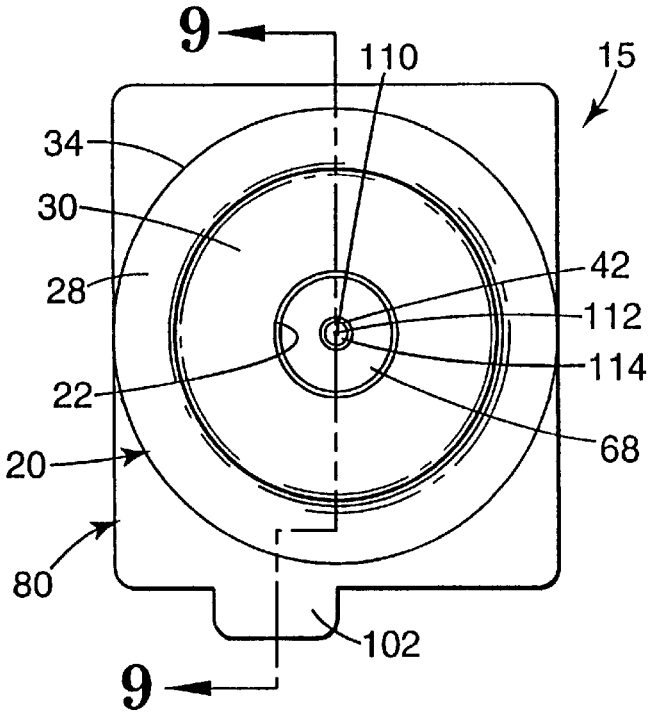
FIG. 8 is a front view of the nozzle assembly.

FIG. 8 is front view of the assembled nozzle assembly 15 having liquid delivery nozzle 110 inserted therein. Liquid delivery nozzle 110 extends through orifice 42 of channel body 50. Liquid nozzle exit 112 of liquid delivery nozzle 110 is located in the general center orifice 42. Liquid is dispensed through liquid nozzle exit 112. Front face 68 of channel body 50 and face 30 of channel cap 20 form annular orifice 22 which is concentric with orifice 42. Atomizing agent is dispensed through orifice 22.

Figure 9:
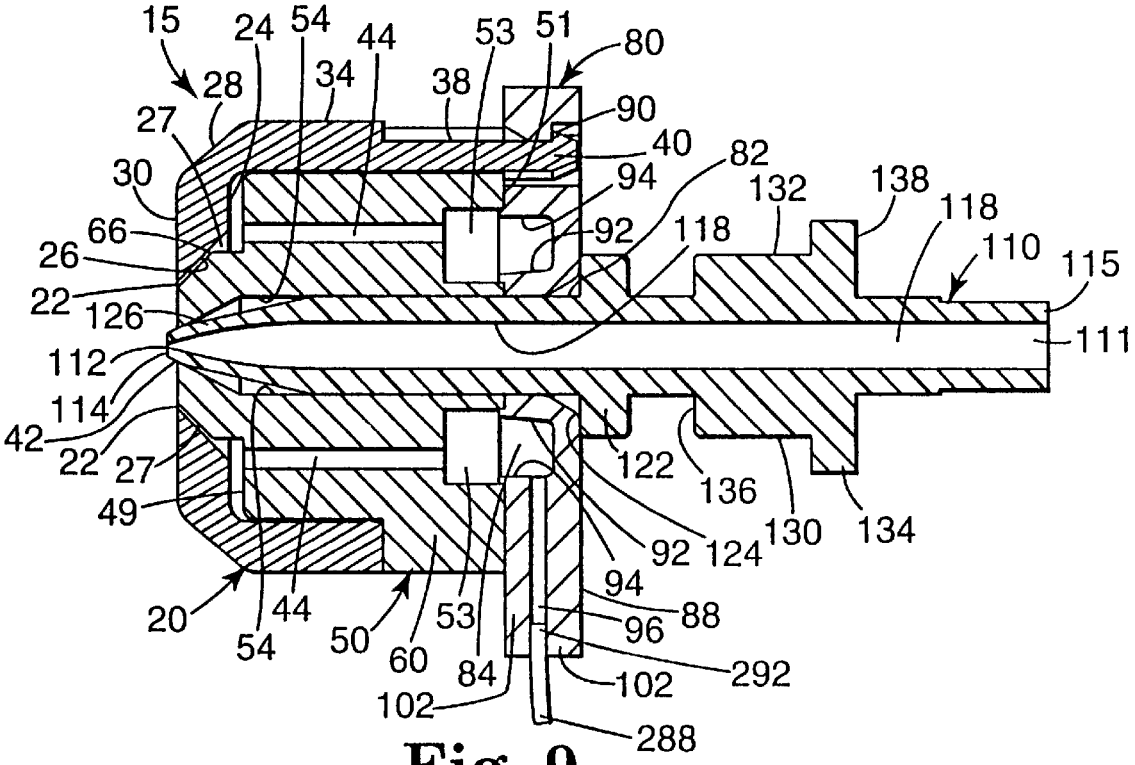
FIG. 9 is a cross-sectional view of the nozzle assembly taken along line 9—9 of FIG. 8.

FIG. 9 is a cross sectional view of nozzle assembly 15 shown in FIG. 8 taken along line 9—9. FIG. 9 is convenient for describing the inner surfaces of channel cap 20, channel body 50, plate 80, and liquid delivery nozzle 110. For clarity of the illustration, liquid delivery nozzle 110 is shown separate from liquid module 250. However, it is understood that liquid nozzle 110 is preferably mounted on liquid module 250 by collar 210. Wall 28 of channel cap 20 has a rear surface 24 opposite face 30. Wall 28 also has a tapered surface 26 which borders orifice 22. Inner surface 54 of cylindrical body 52 forms a passageway extending through channel body 50. This passageway exits first end 49 of channel body 50 in the general center of front face 68 forming orifice 42. Channel body 50 includes an annular chamber 53 located at the second end 51 of cylindrical body 52. Extending along cylindrical body 52 are channels 44. Channels 44 are in fluid communication with chamber 53. Channels 44 exit at the first end 49 of cylindrical body 52 at orifices 45. Plate 80 has hole 82 located in the general center surrounded by annular channel 84. Annular channel 84 is bounded by inner wall 92 and outer wall 94 and is aligned to be in fluid communication with chamber 53. Feed channel 96 of plate 80 extends through standup 102 into the bottom portion of annular channel 84. Plate 80 has snap fit holes 90 for receiving legs 38 of channel cap 20. Liquid delivery nozzle 110 extends through the passageway formed by the inner surface 54 of channel body 50. First end 144 of liquid delivery nozzle 110 extends just beyond orifice 42 to ensure liquid is outside nozzle assembly 15 before it is atomized. Preferably liquid delivery nozzle 110 extends 0.2–1.0 inches (5–25 mm) beyond orifice 42. Front face 124 of forward flange 122 engages with rear face 88 of plate 80.

The atomizing agent flows through second conduit 288 and enters feed channel 96 of plate 80. Atomizing agent then flows into annular channel 84 of plate 80 and continues into annual chamber 53 of channel body 50. Atomizing agent flows from annular chamber 53 into one of several channels 42 of channel body 50. Atomizing agent exits the channels 42 and enters the annular channel 27 formed between the channel body 50 and channel cap 20. Annular channel 27 is bounded on one side by rear surface 24 and tapered surface 26 of wall 28. Annular channel 27 is bounded on the other side by surface 66 and cylindrical shoulder 64 of channel body 50. Channels 44 of channel body 50 are in fluid communication with annular channel 27 leading to orifice 22. Channel 27 is at an angle of approximately 25°–50° relative to the longitudinal axis of liquid delivery nozzle 110. Preferably, channel 27 is at an angle of approximately 33°–46°. More preferably channel 27 is at an angle of approximately 33°. Atomizing agent exits nozzle assembly 15 through orifice 22. Liquid flows from liquid nozzle entrance 111 through liquid channel 118 to liquid nozzle exit 112 to be released outside nozzle assembly 15.

Figure 10:
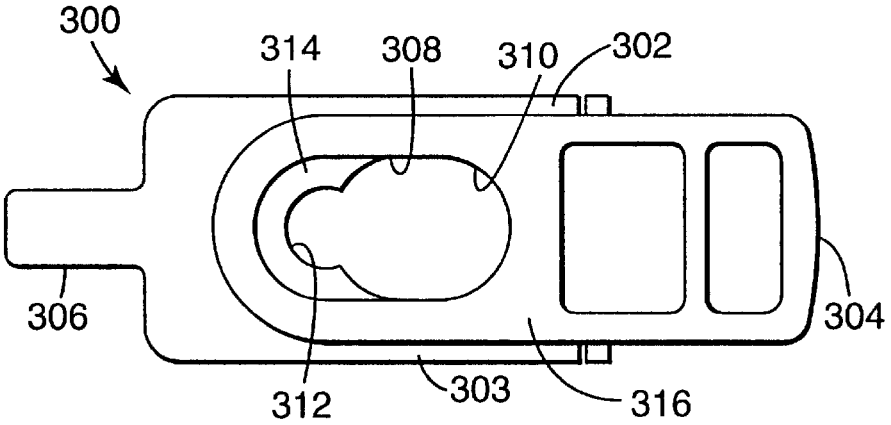
FIG. 10 is a front plan view of the locking mechanism for the liquid delivery nozzle.

FIG. 10 illustrates a preferred embodiment of the nozzle retainer 300 which releasably retains liquid nozzle 110 as described below. Nozzle retainer 300 has a main body 316 with a grip portion 304 at one end and a tab portion 306 opposite grip portion 304. An opening 308 is located in the general center of the main body 316. Opening 308 includes a large release portion 310 and a smaller locking portion 312. Above opening 308 is an upper rail 302 and below opening 308 is a lower rail 303. Upper rail 302 and a lower rail 303 extend out from main body 316 and join together to form tab portion 306 opposite the grip portion 304.

Figure 11:
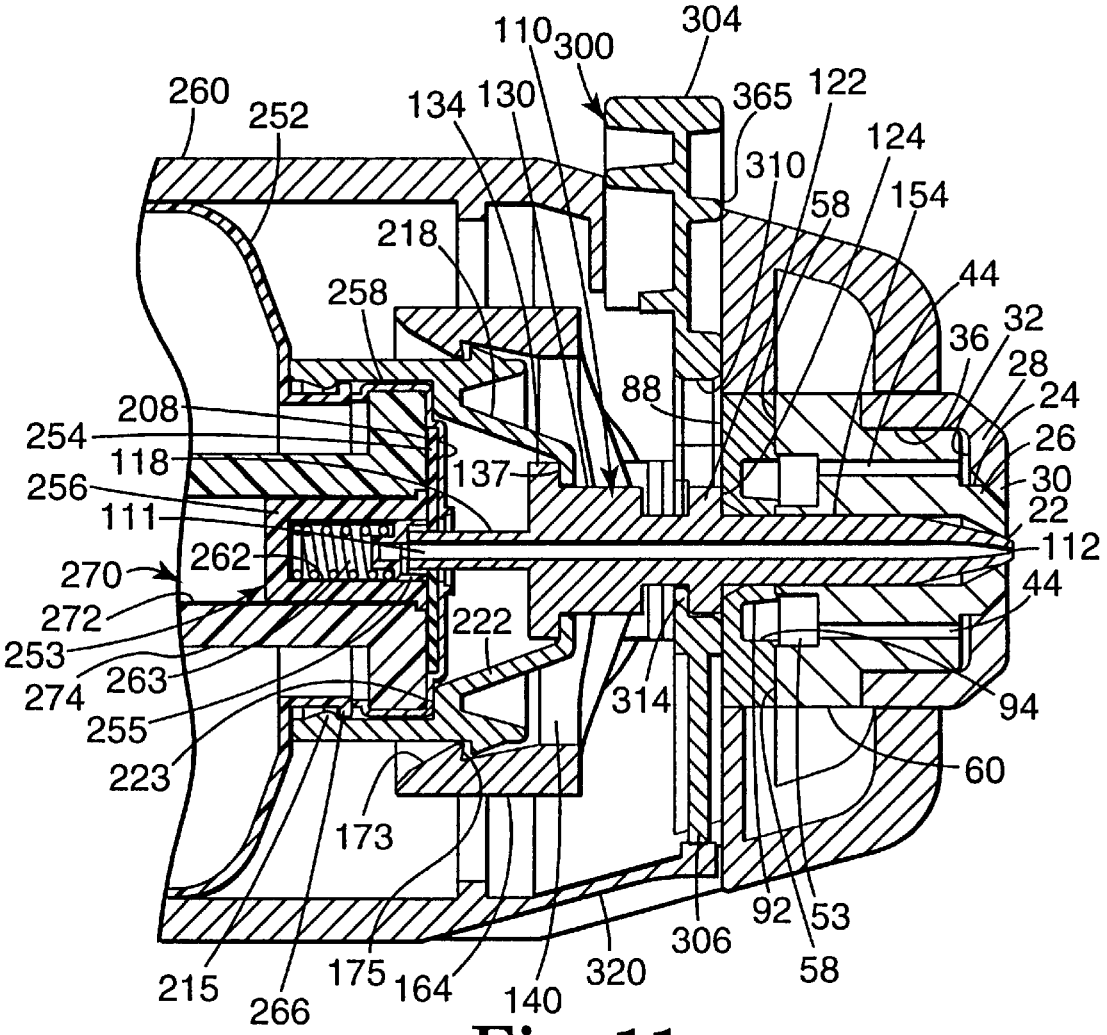
FIG. 11 is a cross-sectional view of the liquid module, liquid module collar, the trigger linkage, and locking mechanism for the liquid delivery nozzle and nozzle assembly taken along line 11—11 of FIG. 1.

FIG. 11 is a cross-sectional view of modular system 10 taken along line 11—11 of FIG. 1. FIG. 11 is convenient for describing the engagement between liquid module 250, liquid module valve 253, liquid module collar 210, the trigger linkage 140, nozzle retainer 300 for the liquid delivery nozzle 110, and nozzle assembly 15.

Nozzle retainer 300 is inserted into nozzle grip opening 365 of nozzle portion 366 on the left side of housing 12. Tab 306 of nozzle retainer 300 engages with spring arm 320 that is integral with the right side of housing 12. When nozzle retainer 300 is pushed inward, it biases against spring arm 320 and centers release portion 310 over hole 82 of plate 80. When nozzle retainer 300 is released, as illustrated, the locking portion 312 of the hole 308 is centered at hole 82 in plate 80.

In FIG. 11, liquid delivery nozzle 110 is mounted on liquid module 250 inside liquid module valve 253. The liquid module valve 253 comprises spring housing 256, spring 263, plunger 255, and gasket 254. Spring 263 is mounted inside spring housing 256. Plunger 255 engages with the spring 263. The gasket 254 is mounted inside cap 258. When second end 115 of liquid delivery nozzle 110 is mounted in orifice 262 of liquid module 250, the second end 115 engages with gasket 254 and plunger 255. Spring 263 biases the liquid delivery nozzle 110 and plunger 255 in a first position. In this first position, plunger 255 is in contact with gasket 254 thereby keeping liquid contained in bladder 270. Spring 263 engages with second end 115 of liquid delivery nozzle 110.

Collar 210 is placed over liquid delivery nozzle 110 onto the liquid module 250 and liquid delivery nozzle 110. Liquid delivery nozzle 110 slides through orifice 220 of collar 210 until front face 137 of rear portion 134 of liquid delivery nozzle 110 engages with the inner surface of cone 218. Rear collar 266 of cap 260 snap fits with inside lip 215 of collar 210 locking both liquid module 250 and liquid delivery nozzle 110 into place.

The following steps illustrate how to insert the assembly of liquid module 250, liquid delivery nozzle 110 and collar 210 into modular system 10. First, nozzle retainer 300 is pushed in by a user to center the larger release portion 310 of opening 308 over hole 82 of plate 80. Second, as illustrated in FIG. 6A, cam spreader 190 is rotated 90° into the second position by turning its handle 200 to spread arms 164, 166 of trigger linkage 140 apart to receive the assembly of liquid module 250, liquid delivery nozzle 110 and collar 210. Third, the assembly of liquid module 250, liquid delivery nozzle 110 and collar 210 is inserted into the liquid module portion 260 of housing 12 to engage with trigger linkage 140. Liquid delivery nozzle is in sliding engagement with inner surface 54 of channel body 50. Front face 124 of forward flange 122 of liquid delivery nozzle engages with rear face 88 of plate 80 thereby allowing liquid nozzle exit 112 to extend just beyond face 30 of channel cap 20. Lip 230 of collar 210 slides up ramp 173 and engages with edge 175 of arms 164, 166 of trigger linkage 140. Fourth, as illustrated in FIG. 6, cam spreader 190 is rotated 90° back into the first position by turning its handle 200 to return arms 164, 166 of trigger linkage 140 to their normal position to lock into place the assembly of liquid module 250, liquid delivery nozzle 110 and collar 210. Finally, the spring-biased nozzle retainer 300 is released by the user to engage the smaller locking portion 314 with the rear face 128 of forward flange 122 of liquid delivery nozzle. Consequently, liquid delivery nozzle 110 is locked into position.

The following steps illustrate how to release the assembly of liquid module 250, liquid delivery nozzle 110, and collar 210 from system 10. First, the spring-biased nozzle retainer 300 is pushed in by a user to center the release portion 310 of opening 308 over hole 82 of plate 80 thereby unlocking liquid delivery nozzle 110. Second, as illustrated in FIG. 6A, cam spreader 190 is rotated 90° into the second position by turning its handle 200 to spread arms 164, 166 of trigger linkage 140 apart to release the assembly of liquid module 250, liquid delivery nozzle 110 and collar 210. Finally, the assembly of liquid module 250, liquid delivery nozzle 110 and collar 210 is pulled out of the liquid module portion 260 of housing 12.

Figure 12:
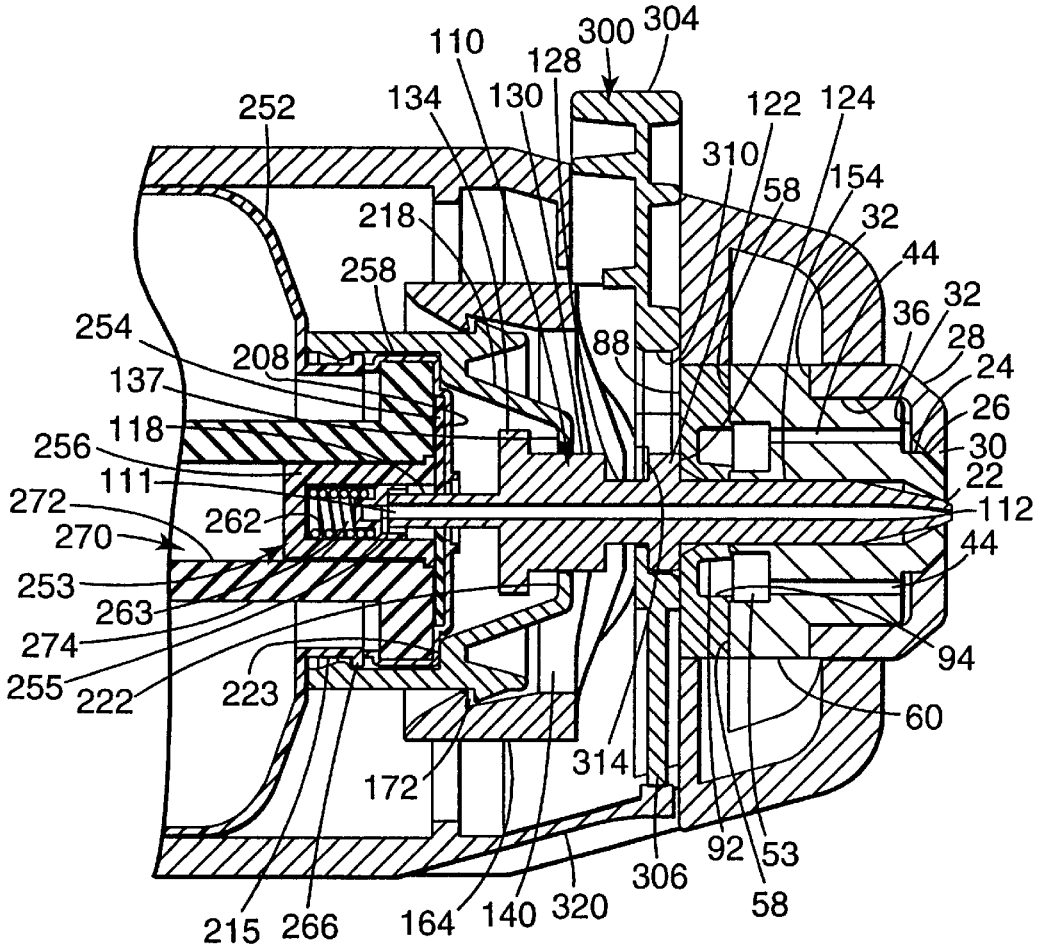
FIG. 12 is a cross-sectional view of the liquid module, liquid module collar, the trigger linkage, and locking mechanism for the liquid delivery nozzle and nozzle assembly taken along line 12—12 of FIG. 2.

FIG. 12 is a cross-sectional view of modular system 10 taken along line 12—12 of FIG. 2. As explained above with respect to FIG. 2, when trigger linkage 140 is rotated about pivot 157, atomizing agent valve 290 is switched to the open position allowing atomizing agent to flow into second conduit 288 and liquid module 250 is moved forward toward liquid nozzle 15. In a second position, the liquid delivery nozzle 110 is depressed into liquid module 250 and second end 115 of the liquid delivery nozzle 110 depresses plunger 255 thereby compressing spring 263. By depressing plunger 255, gasket 254 is no longer in contact with the upper edge of plunger 255, thus allowing fluid to flow into liquid delivery nozzle 110. Fluid flows from bladder 270, through spring housing 256, over the edge of plunger 255 and into the liquid delivery nozzle entrance 111 located at second end 115 of liquid delivery nozzle 110.

This configuration selectively allows first the atomizing agent to flow from atomizing agent module 280 to nozzle assembly 15 and then allows liquid to flow from liquid module 250 to nozzle assembly 15 while the atomizing agent continues to flow.

Liquid channel 118 of liquid delivery nozzle 110 preferably includes a surface finish of SPI #A1 (Society of Plastics Industry, Inc. Washington, D.C.). It is preferred that liquid channel 118 have a smooth, continuous pathway whereby the fluid flows in a laminar manner from the fluid module 250 into the fluid delivery nozzle 110, and exits the nozzle assembly 15 in laminar manner.

Trigger linkage 140, valve assembly 289, liquid module valve 253, along with all the structure that causes liquid module 250 to move relative to the liquid delivery nozzle 110 when trigger 158 is depressed, collectively serve as an actuator. The functions of this actuator include: 1) changing valve assembly 289 from a first closed position to a second open position to allow atomizing agent to flow from first conduit 285 into second conduit 288, which is in fluid communication with nozzle assembly and 2) moving liquid module 250 toward nozzle assembly 15 to allow liquid to flow from the liquid module 250 into nozzle assembly 15. Preferably, the atomizing agent begins to flow through the nozzle assembly 15 before the liquid begins to flow. When the trigger is released, liquid flow stops before the flow of atomizing agent stops. One advantage is to prevent spraying non-atomized liquid. Another advantage is that the vacuum caused by the atomizing agent will draw remaining liquid out of the nozzle to prevent dripping, run-on, or clogging.

Figure 13:
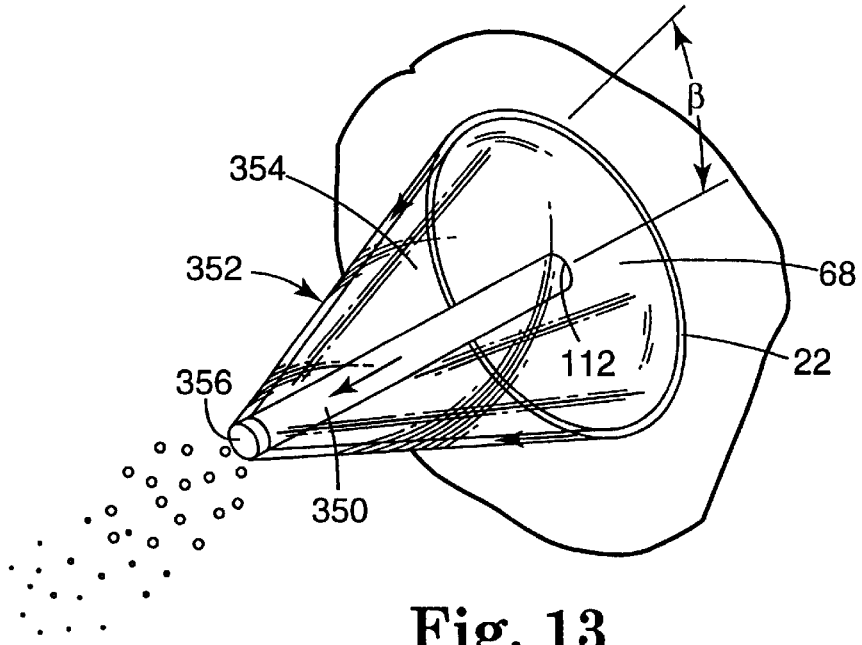
FIG. 13 is a partial isometric view of the nozzle assembly, showing the atomizing interaction between the liquid and the atomizing agent.

FIG. 13 is a partial perspective view of the nozzle assembly of FIG. 8, illustrating the atomizing interaction between the liquid and agent Liquid 350 exits from the liquid delivery nozzle exit 112 in laminar flow. Atomizing agent 352 exits from orifice 22. The annular flow of atomizing agent 352 forms a frusto-conical stream 354. The frusto-conical stream 354 of atomizing agent 352 impinges liquid 350 at an angle β of 25–50° relative to the spray axis. Preferably, β is an angle of 33–46°. More preferably, β is an angle of 33°. Preferably, atomization of the entire flow of liquid takes place at intersection 356 located between 0.020 and 0.080 inches (0.5–2.0 mm) from the front surface 30 of the nozzle assembly 15. Preferably, the entire flow of liquid is atomized into a narrow distribution of small particle size with the mean diameter ranging from 5 to 500 microns. More preferably, the mean diameter ranges from 5–100 microns. Preferably liquid 350 exits liquid delivery nozzle 110 in a constant flow rate and under laminar flow and remains in a laminar state up to the point of impingement 356. In this manner, the atomization will provide a more uniform particle size distribution. The spray configuration illustrated in FIG. 13 atomizes liquids into the desired size and distribution of size. Additionally, the spray configuration has the benefit of reducing overspray, defined as all the atomized liquid that does not contact or impinge with the intended target. This reduction in overspray is because atomizing agent impinges inward on the laminar stream of liquid and not outward.

Liquids useful in several industries can be atomized by modular system 10. For example, liquids could be atomized which are used in the following: personal products (e.g., shave lathers, hair care products, medicinals and pharmaceuticals, colognes, perfumes, deodorants, antiperspirants, and others), household products (e.g., room deodorants and disinfectants, cleaners, waxes and polishes, fabric softeners, and pre-spoters), coatings, veterinarian and pet products, insecticides, automotive products, industrial products, oils, and polymers.

One preferred liquid to be atomized by modular system 10 is adhesive. Other preferred liquids include those with a viscosity of less than 5000 centipoise measured by a Brookfield™ RVT Viscometer or greater than 5,000 centipoise under the right pressures and conditions. System 10 is particularly well suited for atomizing waterbased adhesives containing various type polymers, for example styrene butadiene, neoprene, acrylate, polyvinyl chloride, polyvinyl acetate and ethylene vinyl acetate polymers. System 10 is particularly well-suited for atomizing water-based adhesives with percentage of solids by weight within the range of 17%–70%. Another preferred liquid includes water-based pressure sensitive adhesives commercially available as 3M Scotch-Grip™ 4224-NF Clear Pressure Sensitive Adhesive, available from Minnesota Mining and Manufacturing Co., St. Paul, Minn., and Rohm and Haas ROBOND™ 9631 Emulsion available from Rohm and Haas, Philadelphia, Pa. Other liquids particularly well-suited for system 10 includes water-based neoprene based adhesives, for example 3M Fastbond™ 30-NF Green Contact Adhesive, available from Minnesota Mining and Manufacturing Co., St. Paul, Minn., and DuPont Neoprene Latex 115, available from E. I. DU PONT DE NEMOURS & CO., Wilmington, Del.

Figure 14:
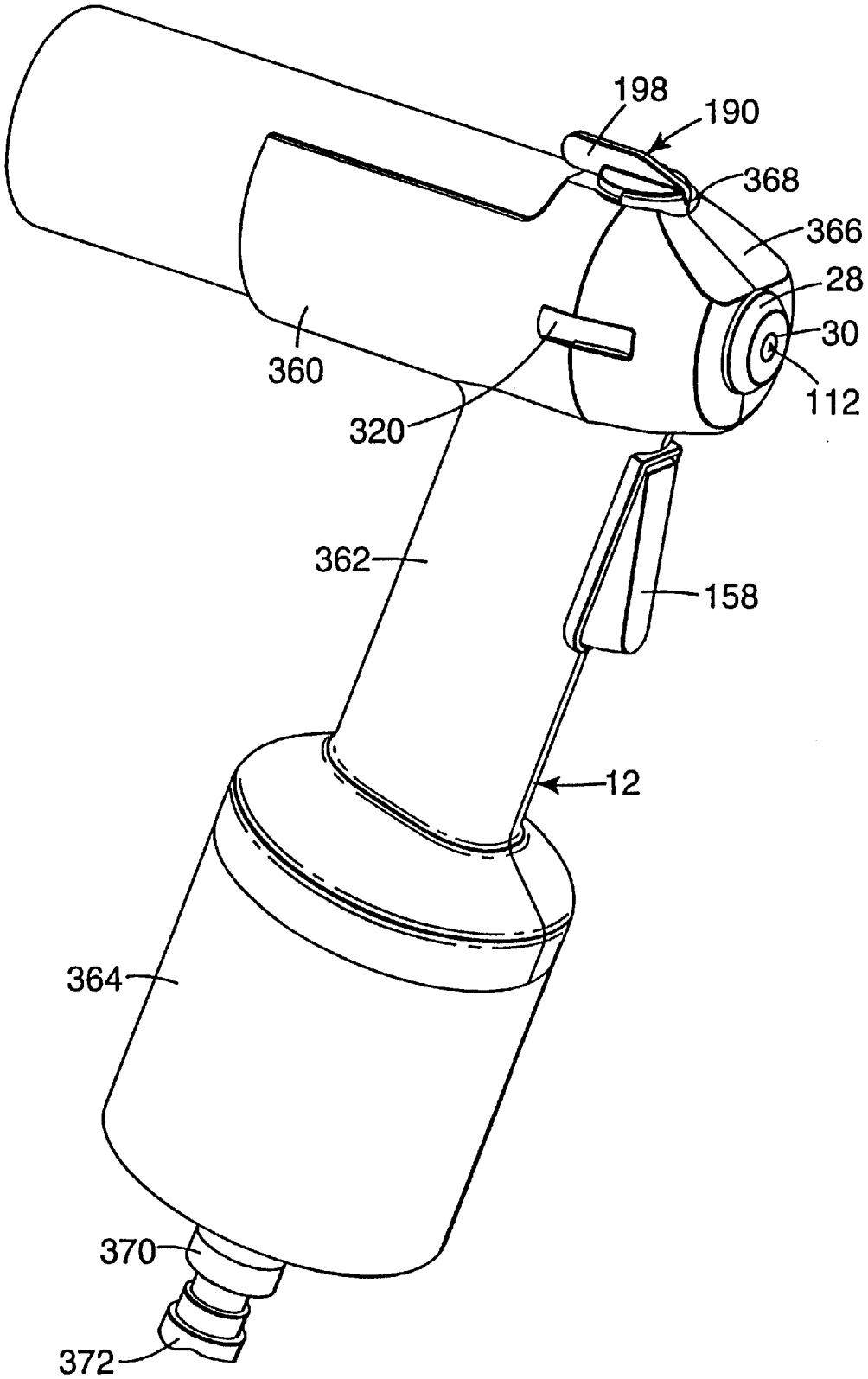
FIG. 14 is a perspective view of an alternate embodiment of the modular system with a gas hose.

FIG. 14 illustrates an alternative embodiment of the present invention. Instead of utilizing an atomizing agent module 280, a user may use a gas hose 372 and coupler 370 to provide a means for providing an atomizing agent The present invention has now been described with reference to several embodiments thereof. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A modular system for atomizing and delivering a liquid, comprising:

a) a liquid module comprising:
  i) a liquid,
  ii) a reservoir body including a cavity for storing said liquid and a reservoir opening for allowing said liquid to exit said cavity, wherein said reservoir body is under force so as to pressurize said liquid, wherein said reservoir body comprises a bladder for storing said liquid, wherein said bladder includes an inside surface defining said cavity and an outside surface, and wherein said liquid module further includes an elastic member contacting said outside surface so as to pressurize said liquid;

b) a means for providing an atomizing agent;

c) a nozzle assembly comprising:
  i) a liquid delivery nozzle in fluid communication with said reservoir opening, said liquid delivery nozzle including a liquid nozzle exit at a first end of said nozzle; and
  ii) an atomizing agent channel in fluid communication with said means for providing an atomizing agent, wherein said atomizing agent channel is configured such that said atomizing agent impinges said liquid external of said liquid nozzle exit so as to atomize said liquid; and d) an actuator, changeable between a first closed position and a second open position, for selectively allowing said atomizing agent to flow from said means for providing atomizing agent to said atomizing agent channel and for selectively allowing said liquid to flow from said cavity to said liquid delivery nozzle.

2. The system of claim 1, wherein said liquid module and said liquid delivery nozzle are attached to one another and removable from said system as a unit.

3. The system of claim 1, wherein said system further comprises a housing, and wherein said nozzle assembly, said actuator, said liquid module, and said atomizing agent module are attached to said housing.

4. The system of claim 1, wherein said liquid module further comprises a canister, and wherein said reservoir body is housed in said canister.

5. The system of claim 1, wherein said means for providing an atomizing agent is an atomizing agent module, and wherein said atomizing agent module is releasably attached to said system.

6. The system of claim 1, wherein said liquid delivery nozzle includes a smooth, continuous pathway from said reservoir opening to said liquid delivery nozzle exit having a surface finish of SPI #A1 whereby said fluid flows in a laminar manner from said liquid module into said liquid delivery nozzle, and exits said nozzle assembly.

7. The system of claim 1, wherein said elastic member comprises a sleeve disposed on said bladder.

8. The system of claim 4, wherein said reservoir body includes a bladder for storing said liquid wherein said bladder includes an inside surface defining said cavity and an outside surface, and wherein said liquid module further includes pressurized gas in said canister outside said reservoir body so as to pressurize said liquid.

9. The system of claim 3, wherein said liquid delivery nozzle is releasably attached to said nozzle assembly, wherein said liquid delivery nozzle is attached to said liquid module, and wherein said liquid delivery nozzle and said liquid module comprise a unit which is releasably attached to said housing.

10. The system of claim 1, wherein said system includes a regulator to maintain said atomizing agent at a constant pressure at said atomizing channel.

11. The system of claim 1, wherein said means for providing an atomizing agent is an atomizing agent module, and wherein said atomizing agent comprises a compressed gas.

12. The system of claim 1, wherein the liquid comprises an adhesive.

13. The system of claim 1, wherein changing said actuator from closed to open initially allows said atomizing agent to flow from said means for providing an atomizing agent to said atomizing agent channel and subsequently allows said liquid to flow from said liquid module to said liquid delivery nozzle, while said atomizing agent is still flowing.

14. The system of claim 12, wherein the adhesive comprises a waterbased adhesive.

15. The system of claim 1, wherein said atomizing agent channel is at an angle relative to the longitudinal axis of said liquid delivery nozzle of between 25–50°.

16. The system of claim 15, wherein said atomizing agent channel is concentric with said liquid delivery nozzle.

17. The system of claim 15, wherein said atomizing agent channel is at an angle relative to the longitudinal axis of said liquid delivery nozzle of approximately 33–46°.

18. The system of claim 1, wherein the liquid comprises a polymer.

19. The system of claim 1, wherein said atomizing agent channel is concentric with said liquid delivery nozzle.

20. The system of claim 3, wherein said housing is sized and configured to be hand held by a user.

21. The system of claim 14, wherein the adhesive comprises a water-based pressure sensitive adhesive.

22. The system of claim 14, wherein the water-based adhesive has greater than 17% solids by weight.

23. The system of claim 1, wherein said atomizing agent comprises a liquefied gas.

24. The system of claim 1, wherein the liquid has a viscosity of no more than 5000 centipoise.

25. The system of claim 22, wherein the water-based adhesive has between 17% to 70% solids by weight.

26. A modular system for atomizing and delivering a liquid, comprising:

a) a liquid module comprising:
  i) a liquid,
  ii) a reservoir body including a cavity for storing said liquid, including a reservoir opening for allowing said liquid to exit said cavity, wherein said reservoir body is under force so as to pressurize said liquid;

b) a means for providing an atomizing agent;

c) a nozzle assembly comprising:
  i) a liquid delivery nozzle in fluid communication with said reservoir opening, said liquid delivery nozzle including a liquid nozzle exit at a first end of said nozzle; and
  ii) an atomizing agent channel in fluid communication with said means for providing an atomizing agent, wherein said atomizing agent channel is configured such that said atomizing agent impinges said liquid external of said liquid nozzle exit so as to atomize said liquid; and d) an actuator, changeable between a first closed position and a second open position, for selectively allowing said atomizing agent to flow from said means for providing atomizing agent to said atomizing agent channel and for selectively allowing said liquid to flow from said cavity to said liquid delivery nozzle, wherein said atomizing agent channel is at angle relative to the longitudinal axis of said liquid delivery nozzle of 33°.

27. A modular system for atomizing and delivering a liquid, comprising:

a) a liquid module comprising:
  i) a liquid,
  ii) a reservoir body including a cavity for storing said liquid, including a reservoir opening: for allowing said liquid to exit said cavity, wherein said reservoir body is under force so as to pressurize said liquid;
  iii) a valve for selectively allowing said liquid to exit said cavity through said reservoir opening;

b) a means for providing an atomizing agent;

c) a nozzle assembly comprising:
  i) a liquid delivery nozzle in fluid communication with said reservoir opening, said liquid delivery nozzle including a liquid nozzle exit at a first end of said nozzle and a second end opposite said exit, wherein said second end is operatively connected to said liquid module valve; and
  ii) an atomizing agent channel in fluid communication with said means for providing an atomizing agent, wherein said atomizing agent channel is configured such that said atomizing agent impinges said liquid external of said liquid nozzle exit so as to atomize said liquid; and d) an actuator, changeable between a first closed position and a second open position, for selectively allowing said atomizing agent to flow from said means for providing atomizing agent to said atomizing agent channel and for selectively allowing said liquid to flow from said cavity to said liquid delivery nozzle, wherein said actuator displaces said liquid module relative to said liquid delivery nozzle so as to cause said nozzle to open said valve.

28. The system of claim 27, wherein said means for providing an atomizing agent is an atomizing agent module, and wherein said atomizing agent module is releasably attached to said system.

29. The system of claim 27, wherein said liquid module and said liquid delivery nozzle are attached to one another and removable from said system as a unit.

30. The system of claim 27, wherein said liquid delivery nozzle includes a smooth, continuous pathway from said reservoir opening to said liquid delivery nozzle exit having a surface finish of SPI #A1 whereby said fluid flows in a laminar manner from said liquid module into said liquid delivery nozzle, and exits said nozzle assembly.

31. The system of claim 27, wherein said means for providing an atomizing agent is an atomizing agent module, and wherein said atomizing agent comprises a compressed gas.

32. The system of claim 27, wherein the liquid comprises an adhesive.

33. A system for atomizing and delivering a liquid, comprising:

a) a liquid module comprising:
  i) a liquid,
  ii) a reservoir body including a cavity for storing said liquid, including a reservoir opening for allowing said liquid to exit said cavity, wherein said reservoir body is under force so as to pressurize said liquid, wherein said reservoir body comprises a bladder for storing said liquid, wherein said bladder includes an inside surface defining said cavity and an outside surface, and wherein said liquid module further includes an elastic member contacting said outside surface so as to pressurize said liquid;

b) a means for providing an atomizing agent;

c) a nozzle assembly comprising:
  i) a liquid delivery nozzle in fluid communication with said reservoir opening, said liquid delivery nozzle including a liquid nozzle exit at a first end of said nozzle; and
  ii) an atomizing agent channel in fluid communication with said means for providing an atomizing agent, wherein said atomizing agent channel is configured such that said atomizing agent impinges said liquid external of said liquid nozzle exit so as to atomize said liquid; and wherein said liquid delivery nozzle is releasably attached to said nozzle assembly, wherein said liquid delivery nozzle is attached to said liquid module, and wherein said liquid delivery nozzle and said liquid module comprise a unit which is releasable from said system; and d) an actuator for selectively allowing said atomizing agent to flow from said means for providing atomizing agent to said atomizing agent channel and for selectively allowing said liquid to flow from said cavity to said liquid delivery nozzle.

34. The system of claim 33, wherein said means for providing an atomizing agent is an atomizing agent module.

35. The system of claim 33, wherein said liquid module further comprises a canister, and wherein said reservoir body is housed in said canister.

36. The system of claim 34, wherein said system further comprises a housing, and wherein said nozzle assembly, said actuator, said liquid module, and said atomizing agent module are attached to said housing.

37. The system of claim 33, wherein said elastic member comprises a sleeve disposed on said bladder.

38. The system of claim 33, wherein changing said actuator from closed to open initially allows said atomizing agent to flow from said means for providing an atomizing agent to said atomizing agent channel and subsequently allows said liquid to flow from said liquid module to said liquid delivery nozzle, while said atomizing agent is still flowing.

39. The system of claim 33, wherein said atomizing agent channel is at an angle relative to the longitudinal axis of said liquid delivery nozzle of between 25–50°.

40. The system of claim 39, wherein said atomizing agent channel is concentric with said liquid delivery nozzle.

41. The system of claim 39, wherein said atomizing agent channel is at an angle relative to said liquid delivery nozzle of approximately 33–46°.

42. The system of claim 39, wherein said atomizing agent channel is concentric with said liquid delivery nozzle.

43. The system of claim 33, wherein said liquid delivery nozzle includes a smooth, continuous pathway from said reservoir opening to said liquid delivery nozzle exit having a surface finish of SPI #A1 whereby said liquid flows in a laminar manner from said liquid module into said liquid delivery nozzle, and exits said nozzle assembly.

44. The system of claim 33, wherein the liquid has a viscosity of no more than 5000 centipoise.

45. The system of 33, wherein the liquid comprises an adhesive.

46. The system of claim 45, wherein the adhesive comprises a water-based adhesive.

47. The system of claim 46, wherein the water-based adhesive has greater than 17% solids.

48. The system of claim 36, wherein said atomizing agent module is releasably attached to said housing.

* * * * *